US005078304A

United States Patent [19]

Schneider

[11] Patent Number: 5,078,304

[45] Date of Patent: Jan. 7, 1992

[54] DEVICE FOR EMPTYING A BARREL HAVING A HIGHLY-VISCOUS CONTENT

[76] Inventor: Friedhelm Schneider, Fichtenstrasse 7, D-5226 Reichshof-Wiehl, Fed. Rep. of Germany

[21] Appl. No.: 559,854

[22] Filed: Jul. 30, 1990

[30] Foreign Application Priority Data

Aug. 4, 1989 [DE] Fed. Rep. of Germany ..... 3925866

[51] Int. Cl.[5] ..... B67D 5/64

[52] U.S. Cl. ..... 222/168; 53/527; 53/587; 100/104; 222/386; 222/405; 242/7.22

[58] Field of Search ..... 222/167, 168, 185, 386, 222/405; 100/104, 116, 239; 53/527, 587; 242/7.21, 7.22; 493/299

[56] References Cited

U.S. PATENT DOCUMENTS 584,281 6/1897 Allen ..... 242/7.22
2,589,041 3/1952 Bremer ..... 493/299 X
3,487,965 1/1970 Gale ..... 214/152
4,564,469 1/1986 Cochet et al. ..... 53/527 X
4,632,277 12/1986 Pallante ..... 222/146.2
4,978,042 12/1990 Fidler ..... 222/185 X

FOREIGN PATENT DOCUMENTS 1108102 5/1961 Fed. Rep. of Germany .

*Primary Examiner*—Michael S. Huppert
*Assistant Examiner*—Joseph A. Kaufman
*Attorney, Agent, or Firm*—Flynn, Thiel, Boutell & Tanis

[57] ABSTRACT

A device for emptying a barrel having a highly viscous content by pushing a piston into the barrel. In order to prevent the barrel from being deformed or damaged, the device includes a turntable onto which the barrel can be mounted. The barrel can be reinforced on its outer periphery by means of a flexible looping element wound therearound, which looping element is unwound from or wound onto a drum.

9 Claims, 2 Drawing Sheets

DEVICE FOR EMPTYING A BARREL HAVING A HIGHLY-VISCOUS CONTENT

FIELD OF THE INVENTION

The invention relates to a device for emptying a barrel having a highly viscous content, comprising a piston which can be pushed into the barrel.

BACKGROUND OF THE INVENTION

Barrels or similar containers filled with highly viscous materials, for example a silicone paste, are usually emptied by pushing a piston into the open barrel. The highly viscous material can be pushed and conveyed out of the barrel through pipelines. It is also possible to push, as a part of the piston or in place of the piston, the lid of the barrel into the inside of the barrel in order to empty same.

Depending on the viscosity of the material to be emptied from the barrel, a considerable amount of pressure is needed in order to push the material into the pipeline. This causes the barrel to be exposed to very high mechanical stress during the emptying operation.

For reasons of weight and expense, barrels are usually designed with very thin walls and have a stability which is just sufficient to avoid damage to the barrel during transport. However, the barrel is not designed to withstand the stress occurring during an emptying thereof. For example, such barrels are made of plastic or cardboard.

To prevent the barrel from bursting due to the high pressure developed during emptying of the barrel, the state of the art suggests to place split metal sleeves or half-shells, for example of sheet metal, around the barrel and to enclose and reinforce same in this manner. The mounting and closing off of the half-shells or sleeves is very complicated, requires a considerable amount of manual labor and is, therefore, disadvantageous.

It furthermore has proven to be disadvantageous that the sleeves or half-shells must be adapted in an exact manner to the outside dimensions of the barrel, so that with a device on which many different barrel sizes are to be emptied, a number of such sheet-metal sleeves or half-shells are needed.

SUMMARY OF THE INVENTION

The basic purpose of the invention is to provide a device of the above-mentioned type which with a simple design and simple, operatively safe use enables an emptying of barrels of different sizes and can thereby be used in particular automated arrangements.

The purpose is attained according to the invention by the barrel being mountable on a turntable and by an end section of a looping element being fastened to the turntable to loop around the barrel when the turntable is rotated, which looping element can be wound up onto and unwound from a drum.

The device of the invention is distinguished by a number of significant advantages. Since the barrel can be placed onto the turntable, it is possible to loop the looping element completely around the barrel and to thus reinforce its outer periphery. Since the looping element is flexible, it can adapt to the respective outer contours of the barrel. It is therefore not necessary to change the device over to adjust to different shapes and dimensions of barrels, rather these can be emptied in any desired sequence. Thus, it is possible in particular to also compensate for tolerance variations in dimensions and/or for slight amounts of damage to filled barrels.

Since the flexible looping element can be wound onto and unwound from a drum, the looping and release of the barrel can be automated without necessitating further handling by operators.

The flexible looping element can according to the invention be designed in the form of a rope, a wire band or a chainlike looping element consisting of individual elements.

A guide element for the looping element is preferably arranged between the drum and the turntable in order to assure its vertical guiding. This enables the looping element to be wound onto the outer surface of the barrel in adjoining layers. The individual layers of the looping element can be directly adjacent to one another or can be spaced from one another.

The guide element includes preferably an elevationally adjustable spindle nut. It is thereby advantageous when the spindle nut on a threaded spindle is, in response to each complete turn of the turntable, elevationally adjustable a distance substantially equal to the width of the looping element. Thus, achieved by automation that the looping element is automatically rolled in an orderly manner onto the outer periphery of the barrel or is rolled off in an orderly manner from the outer periphery.

The turntable and the threaded spindle are preferably drivingly connected with one another, for example through a gear drive. The design makes it possible to drive both the turntable and also the threaded spindle by means of only one single motor.

In order to prevent the turntable from being damaged when the piston is pushed into the barrel and in order to prevent in particular the support of the turntable and its drive from being damaged, the turntable is supported for axial movement on a frame and is initially urged away from a support surface on the frame by means of an elastic initial tensioning element. Thus, the turntable can be freely rotated without an axial pressure by the piston, while when the piston applies a force the turntable is pressed against the support surface of the base. This at the same time prevents the turntable and thus the barrel from relative turning movement during the operation of removing its content and prevents thereby the possible loosening of the flexible looping element.

To assure that the barrel is fastened to the turntable in a suitable manner, it is provided that at least one releasable holding jaw is supported on the turntable. The holding jaw is used to grip the barrel and to lock the barrel on the turntable, for example by the holding jaw engaging a bottom flange or a reinforcing edge of the barrel. The holding jaw is preferably operated by means of a pressure-medium cylinder. Further, it is particularly favorable if two holding jaws are provided.

The drum onto which the flexible looping element is wound or from which it is unwound is preferably operatively connected to a separate drive motor. Further, it is particularly advantageous when the drum has braking means. The drive motor can hereby also function as a brake in order to assure a sufficient tensioning of the looping element when it is being wound around the barrel.

BRIEF DESCRIPTION OF THE DRAWINGS

The invention will be described hereinafter in connection with one exemplary embodiment and the drawings, in which.

DETAILED DESCRIPTION

Figure 1:
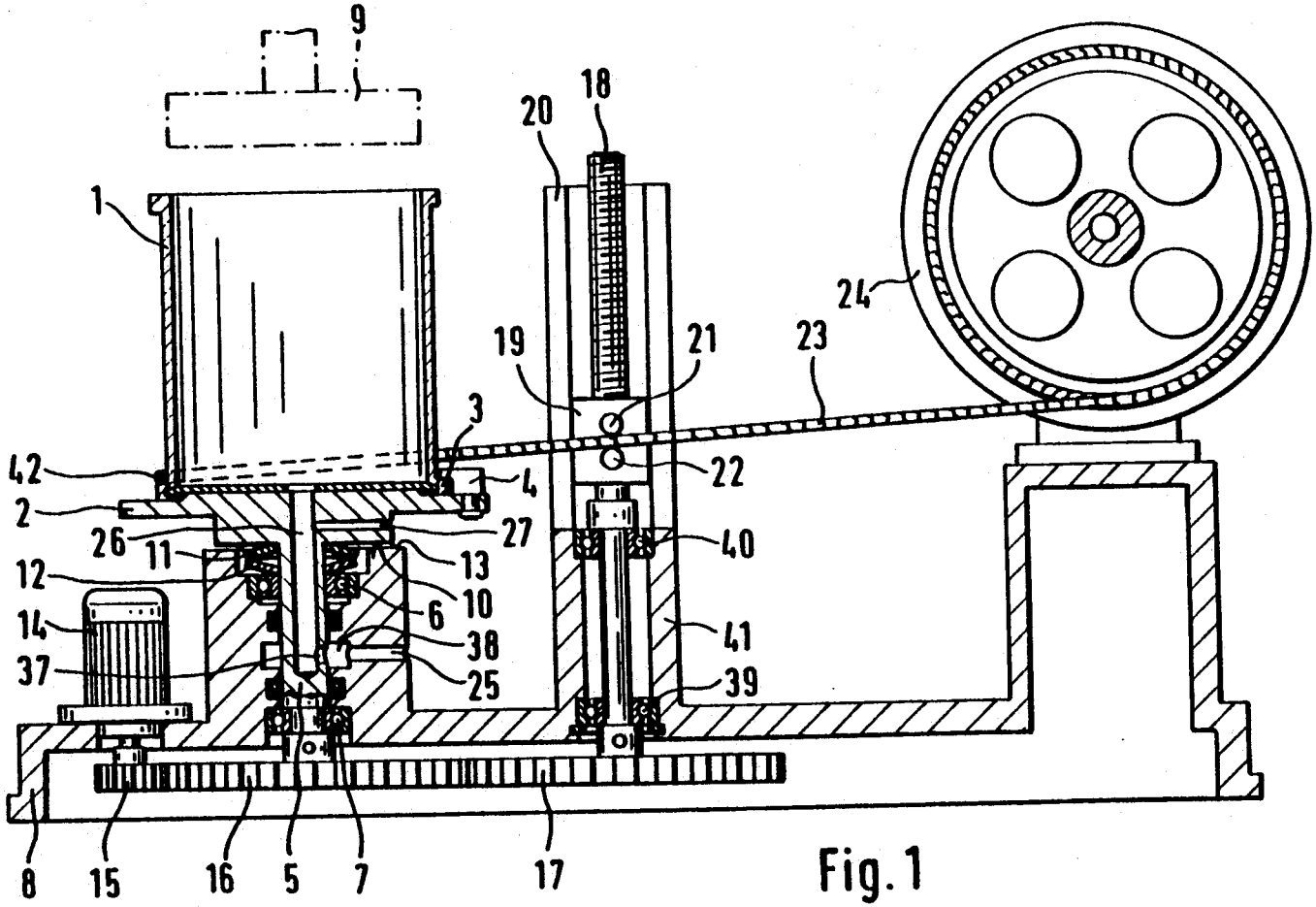
FIG. 1 is a side view, partially in cross section, of the device of the invention.
Figure 2:
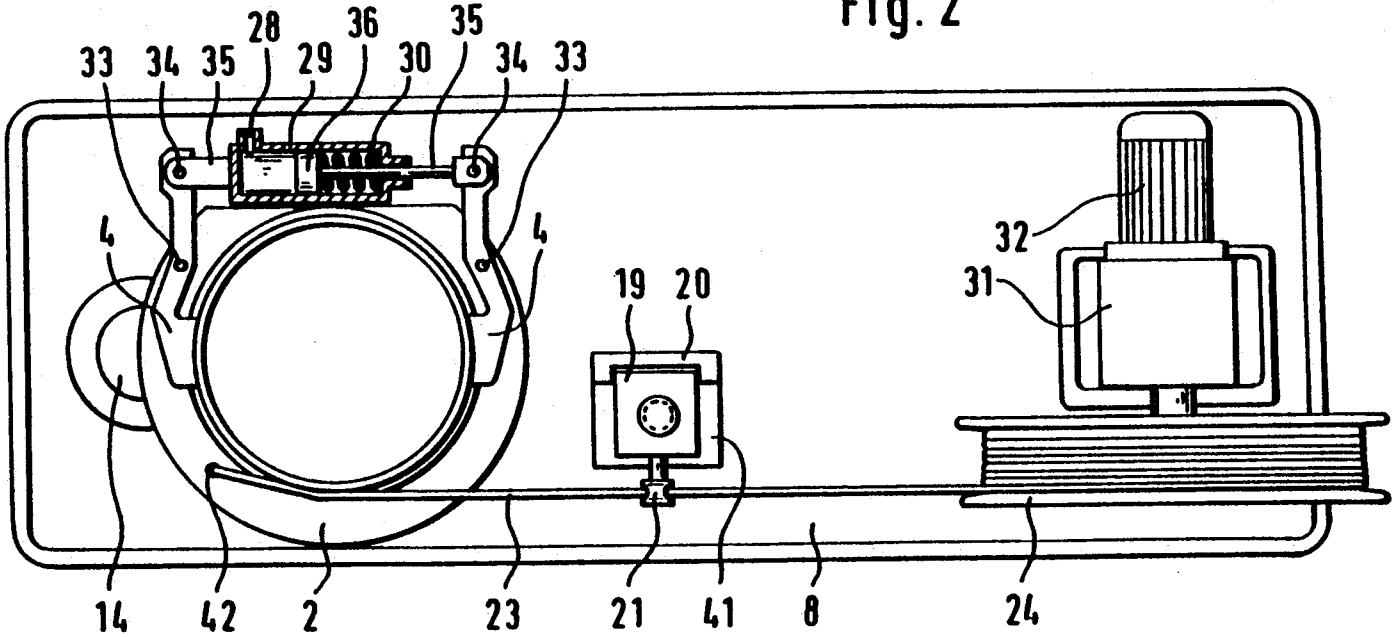
FIG. 2 is a top view of the device illustrated in FIG. 1.

FIGS. 1 and 2 illustrate a substantially cylindrical barrel 1 having a bottom wall tightly sealingly connected to the cylindrical part of the barrel 1 by means of a reinforcing edge 3. The barrel 1 is shown in an open state. FIG. 1 shows a piston 9 in dash-dotted lines above the barrel. The piston 9 can be pushed into the inside of the barrel 1. The piston 9 has, as known from the state of the art, at least one opening through which the content of the barrel 1 can flow out upwardly when the piston 9 is pushed into the barrel 1.

The device of the invention includes a frame 8 on which a turntable 2 is rotatably supported about a vertical axis. The turntable 2 has a shaft 5 at its lower end, which shaft is rotatably supported on the frame 8 by means of bearings 6 and 7.

The area of the frame 8 receiving the bearings 6 and 7 has an upper bearing surface 13, against which can rest the bottom surface 10 of the turntable 2. The shaft 5 is for this purpose axially movably supported and is initially tensioned upwardly by means of a pair of cup springs 11, 12. The turntable 2 is freely rotatable in the state shown in FIG. 1. The turntable 2 is moved downwardly against the initial force of the cup springs 11, 12 by the pressure applied by means of the piston 9 so that the bottom surface 10 rests against the bearing surface 13. This blocks a further rotation of the turntable 2. The load is at the same time removed from the bearings 6, 7 in order to prevent them from being damaged or destroyed by the axial pressure of the piston 9.

The lower end of the shaft 5 is operatively connected to a gear 16 mating with a driving gear 15 mounted on the driven shaft of a motor 14 supported on the frame 8. Thus, the turntable 2 can be rotated by means of the motor 14.

FIG. 2 shows in particular that two holding jaws 4 are supported on the turntable 2. The holding jaws are pivotal in order to grip or release the barrel 1 or its reinforcing edge 3. The holding jaws 4 are pivotal about the swivel bearing 33. Legs 35 are hinged to the free legs of each of the holding jaws 4 by bolts 34. One of the legs 35 is connected to a piston 36 movable in a pressure-medium cylinder 29, while the other leg 35 is directly connected to the pressure-medium cylinder 29. A movement of the piston 36, which is initially tensioned by means of a spring 30, thus results in a pivoting of the two holding jaws 4.

The pressure-medium cylinder 29 is loaded with pressure medium applied through an opening 28 which is connected to a bore 27 in the turntable 2 through a pipeline (not illustrated). The bore 27 terminates in a central bore 26 in the shaft 5 of the turntable. A lateral bore 37 exists at the lower end of the central bore 26 on the shaft 5, which bore 37 terminates in an annular channel 38 connected to a bore 25. Pressure medium from a pump (not illustrated) can be supplied through the bore 25 or pressure medium can be discharged through the bore 25 in order to operate the pressure-medium cylinder 29.

The spring 30 causes in the exemplary embodiment the holding jaws 4 to be initially tensioned outwardly into a released position when pressure medium is not pushed into the inside of the pressure-medium cylinder 29. This results in an automatic release of the barrel when the fluid pressure is exhausted.

A vertical extending, threaded spindle 18 is furthermore rotatably supported on the frame 8. The threaded spindle carries a gear 17 at its lower end which mates with the gear 16 so that the threaded spindle 18 is also rotated when the turntable 2 rotates. The frame 8 includes a guide-bar bracket 20 oriented above the bearings 39, 40 which rotatably support the threaded spindle. The bearings 39, 40 are mounted in a cylindrical shoulder 41 of the base 8. A spindle nut 19 is movably guided in the guide-bar bracket 20 and is threadedly engaged with the threaded spindle 18. Thus, rotating the threaded spindle 18 results in a movement of the spindle nut 19 in the guide-bar bracket 20.

The spindle nut 19 supports guide rollers 21, 22, through which a flexible looping element 23 can be guided. The free end of the looping element 23 is fastened to the turntable 2 at a location identified by the reference numeral 42.

As shown in FIGS. 1 and 2, a drum or reel 24 is rotatably supported on the frame 8 adjacent to the threaded spindle 18. The drum 24 is operatively connected to a motor 32 through a gear transmission 31. The motor 32 can be used both for driving the drum 24 during winding up of the looping element 23 and also as a brake during unwinding of the looping element 23.

The elastic looping element can be designed for example like a steel wire, a steel band or a link element. The pitch of the threaded spindle 18 and the translation of the gears 16 and 17 are designed such that upon a complete rotation of the turntable 2, the spindle nut 19 is moved upwardly or downwardly a distance substantially equal to the thickness of the looping element 23.

The invention is not to be limited to the illustrated exemplary embodiment, rather many possibilities for modification will be evident to the man skilled in the art and yet be within the scope of the invention.

The embodiments of the invention in which an exclusive property or privilege is claimed are defined as follows:

1. A device for emptying a barrel having a highly viscous content, and including a piston supported for movement into and out of the barrel, said device comprising a turntable and first support means for supporting said turntable for rotation, said turntable including a fastening means for facilitating a releasable fastening of the barrel to said turntable for rotation therewith, a drum and second support means for supporting said drum for rotation, a flexible looping element wound onto said drum and being adapted to be unwound therefrom, one end of said flexible looping element being fastened to said turntable and said flexible looping element being adapted to loop around the barrel, and drive means for rotatably driving said turntable so that as said turntable is rotated, said looping element is unwound from said drum as it is simultaneously wound onto the barrel.

2. The device according to claim 1, wherein between said drum and said turntable there is provided a guide element for guiding said flexible looping element onto and off from the barrel.

3. The device according to claim 2, wherein said guide element includes a vertically upstanding threaded spindle and an elevationally variable spindle nut threadly engaging said threaded spindle, said spindle nut being elevationally variable a distance substantially equal to the diameter of said flexible looping element during each rotation of said turntable.

4. The device according to claim 3, wherein said drive means includes means for drivingly connecting said turntable and said threaded spindle.

5. The device according to claim 1, wherein said device includes a frame with a bearing surface thereon, wherein said turntable is axially movably supported on said frame and is initially urged away from said bearing surface by means of an elastic initial tensioning element.

6. The device according to claim 1, wherein said fastening means includes at least one releasable holding jaw mounted on said turntable and adapted to move into and out of engagement with the barrel.

7. The device according to claim 6, wherein a pressure-medium cylinder is provided for effecting a driving of said holding jaw into and out of engagement with the barrel.

8. The device according to claim 1, wherein a further drive means is provided for rotatably driving said drum.

9. The device according to claim 8, wherein said further drive means drives said drum in a direction to effect a winding of said flexible looping element onto said drum and, therefore, functions as a braking means when activated during times that said drive means is effecting a winding of said flexible looping element onto the barrel.

* * * * *